US005285176A

United States Patent [19]

Wong et al.

[11] Patent Number: 5,285,176

[45] Date of Patent: Feb. 8, 1994

[54] FLAT CAVITY RF POWER DIVIDER

[75] Inventors: Harry Wong, Monterey Park; Gary A. Hill, El Segundo; Gregory D. Kroupa; Mon N. Wong, both of Torrance, all of Calif.

[73] Assignee: Hughes Aircraft Company, Los Angeles, Calif.

[21] Appl. No.: 957,070

[22] Filed: Oct. 5, 1992

Related U.S. Application Data

[63] Continuation of Ser. No. 695,845, May 6, 1991, abandoned.

[51] Int. Cl.[5] ..... H01P 5/12

[52] U.S. Cl. ..... 333/137; 343/853

[58] Field of Search ..... 333/125, 126, 134, 135, 333/137; 343/853, 777, 778, 771

[56] References Cited

U.S. PATENT DOCUMENTS

| | | | |
|---|---|---|---|
| 2,908,906 | 10/1959 | Kurtz | 343/778 X |
| 2,929,064 | 3/1960 | Kelly | 343/771 |
| 3,230,481 | 1/1966 | Lewis | 333/135 |
| 3,363,253 | 1/1968 | Ratkevich et al. | 343/771 |
| 3,524,151 | 8/1970 | Safran | 333/137 |
| 4,263,568 | 4/1981 | Nemit | 333/127 |
| 4,429,313 | 1/1984 | Muhs, Jr. et al. | 343/771 |
| 4,556,853 | 12/1985 | Clark | 333/26 |
| 4,933,651 | 6/1990 | Benahim et al. | 333/125 |
| 4,985,708 | 1/1991 | Kelly | 343/771 |
| 5,128,689 | 7/1992 | Wong et al. | 333/137 X |

FOREIGN PATENT DOCUMENTS

| | | | |
|---|---|---|---|
| 835913 | 4/1952 | Fed. Rep. of Germany . | |
| 1443033 | 7/1976 | United Kingdom | 343/771 |

*Primary Examiner*—Benny T. Lee

*Attorney, Agent, or Firm*—William J. Streeter; Wanda K. Denson-Low

[57] ABSTRACT

A flat cavity RF power divider wherein a flat cavity and an input waveguide share a common wall, coupling slots being disposed in the common wall offset from the centerline of the input waveguide for exciting a dominant $TE_{4,0}$ mode in the flat cavity, the power divider also including short circuit means for exciting the transverse axis column of the flat cavity, and RF absorber means in the cavity to improve the frequency response of the divider, output coupling means also being provided for providing an RF power output.

12 Claims, 6 Drawing Sheets

FIG.3.

1.5 λg

| DESIGN PHASE | MEASURED PHASE | | | |
|---|---|---|---|---|
| 0° | P1 0° | P5 0° | P9 0° | P13 0° |
| -540° | P2 -665° | P6 -678° | P10 -673° | P14 -676° |
| -1080° | P3 -1181° | P7 -1206° | P11 -1204° | P15 -1214° |
| -1620° | P4 -1786° | P8 -1793° | P12 -1788° | P16 -1796° |

1.5 λg

FIG.4.

| DESIGN PHASE | 0° | -540° | -1080° | -1620° |
|---|---|---|---|---|
| MEASURED PHASE | P1 0° | P5 -519° | P9 -1058° | P13 -1597° |
| | P2 0° | P6 -523° | P10 -1059° | P14 -1597° |
| | P3 0° | P7 -531° | P11 -1071° | P15 -1616° |
| | P4 0° | P8 -513° | P12 -1048° | P16 -1592° |

FIG.5.

| THEO-RETICAL VALUE | MEASURED AMPLITUDE | | | |
|---|---|---|---|---|
| -12dB | P1 -17dB | P5 -14.8dB | P9 -14.5dB | P13 -16.5dB |
| -12dB | P2 -17dB | P6 -15.3dB | P10 -16dB | P14 -16.8dB |
| -12dB | P3 -13.5dB | P7 -13.7dB | P11 -14dB | P15 -14.3dB |
| -12dB | P4 -16.6dB | P8 -14.2dB | P12 -14dB | P16 -15dB |

FLAT CAVITY RF POWER DIVIDER

This invention was made with Government support under Contract No. F19628-89-C-0060 awarded by the Department of the Air Force. The Government has certain rights in this invention.

This is a continuation of application Ser. No. 07/695,845, filed May 6, 1991, now abandoned.

BACKGROUND

The present invention relates generally to microwave transmission systems and more particularly to an RF power divider capable of handling relatively high power with forced air cooling.

Cavity power dividers have proven to be the best suited component to interface with active phase array elements of satellite microwave transmission antenna systems. Prior RF power dividers are mostly corporate feed types. The prior art includes either waveguide tee junctions, or hybrid couplers. Square coaxial hybrid couplers are also used as power dividers.

One example of a prior art power divider is described in a document entitled "44 GHz Monolithic Conformal Active Transmit Phased Array Antenna," 1987, delivered under contract number F19628-83-C-0115 by Harris Corporation. There is disclosed a power divider consisting of a rectangular waveguide plate (parallel plate or Pillbox Feed), a ridged waveguide to coaxial transition, a short section of ridged waveguide, and coaxial to output port.

Another example of the prior art is described in a document entitled "20 GHz Monolithic Conformal Active Receive Phased Array Antenna," March 1989, delivered under contract number F19628-83-C-0109 by Ball Aerospace Corporation. The Ball power divider consists of complex microstrip coupler power dividing circuits, wave-guide-to-E-plane transitions, and mini-coax connected directly to microstrip as output port. The disadvantages of these above-noted conventional devices include: low thermal dissipation efficiency, complex cooling systems, high manufacturing costs, and high RF insertion loss.

SUMMARY OF THE INVENTION

In view of the foregoing factors and conditions characteristic of the prior art, it is a primary objective of the present invention to provide a new and improved flat cavity RF power divider. Another objective of the present invention is to provide a light weight and less bulky flat cavity RF power divider. Still another objective of the present invention is to provide a compact flat cavity RF power divider that may be forced air cooled and is simple in construction. Yet another objective of the present invention is to provide a flat cavity RF power divider that provides desirable coaxial output ports for active element interfaces, and that has a 5% bandwidth with smooth phase and amplitude output. Still a further objective of the present invention is to provide a flat cavity RF power divider that utilizes no tuning screws or matching reactors, and has a very thin profile of less than 1 inch at 14.35 GHz. Yet a further objective of the present invention is to provide a flat cavity RF power divider that implements a 1 to 16 power division within a limited area, and is very suited to interface with active phase array elements.

In accordance with an embodiment of the present invention, a flat cavity RF power divider includes a flat cavity structure having horizontal centerline in a cavity broadwall thereof, and upper and lower longitudinal walls. An input waveguide structure having an input port at one end and a longitudinal centerline in a waveguide broadwall thereof is also included, the waveguide broadwall being shared with the cavity broadwall, and the longitudinal centerline being parallel to and offset from the centerline of the flat cavity structure. Coupling means including a plurality of longitudinal shunt slots are disposed in the common wall along the cavity's longitudinal centerline for exciting a dominant $TE_{4,0}$ mode in the cavity's structure. The invention also includes curved waveguide short circuit means disposed in the waveguide structure for creating a relatively high standing-wave along the waveguide structure and provides a maximum E-field to excite each of the slots and thereby excites the transverse axis column of the flat cavity structure, and RF absorber means disposed in the flat cavity structure along the longitudinal walls thereof for frequency response improvement of the power divider. Output coupling means is also associated with the flat cavity structure for providing an RF power output.

The invention may be implemented wherein the input waveguide structure is a WR-62 waveguide and the input port is at an outer end thereof. Alternatively, the input waveguide structure may include an elongated horizontal section and an elongated orthogonal feed section joining the horizontal section at a waveguide tee junction disposed centrally along the horizontal section, the input port being disposed at an outer end of the feed section.

According to an embodiment of the invention, the coupling means includes four longitudinal shunt slots spaced at multiples of quarter wavelengths, and the output means may include 16 coaxial sub-miniature adapter (SMA) output coupling probes extending into the flat cavity structure and spaced about 1.5 $\lambda g$ apart.

Thus, it should be clear that an RF power divider that, in contradistinction to the prior art, exhibits high thermal efficiency with simplified cooling capabilities, low costs of manufacture and low RF insertion loss would constitute a significant advancement over the prior art.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which:

FIG. 3 is a chart showing phase measurements made from top to bottom within the embodiment of FIG. 1;

FIG. 4 is a chart showing phase measurements made from left to right within the embodiment of FIG. 1;

FIG. 5 is a chart showing absolute amplitude measurements made in the cavity power divider of FIG. 1, at center frequency;

Detailed Description

Figure 1:
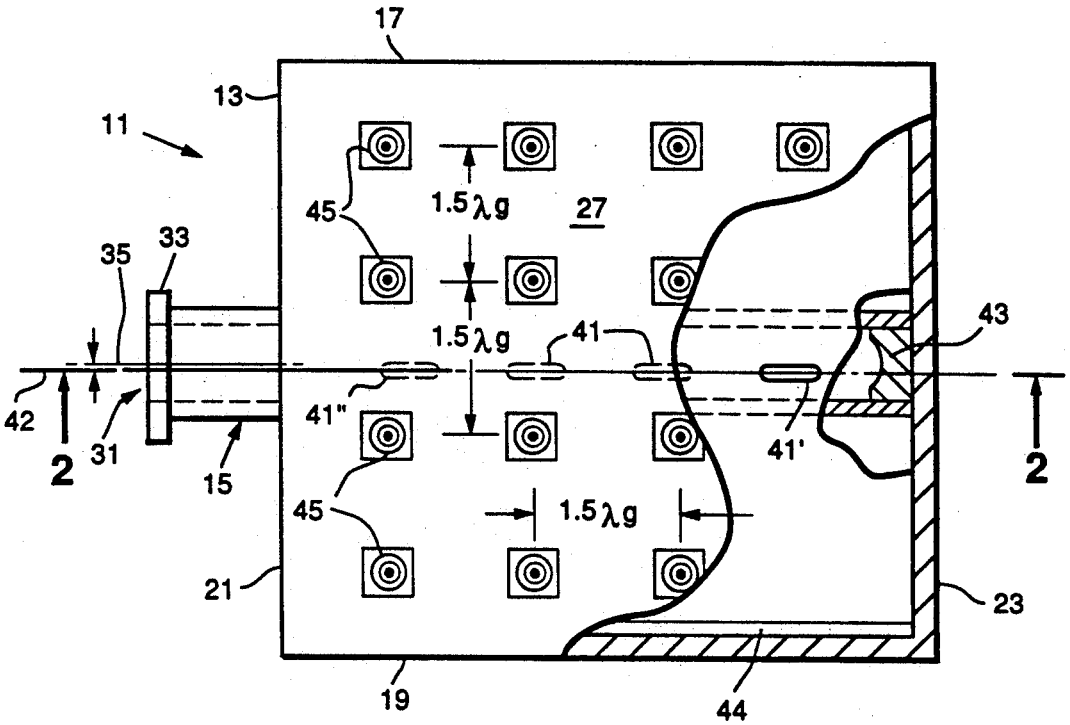
FIG. 1 is a side elevational view, partially broken away, of a flat cavity RF power divider constructed in accordance with the present invention.
Figure 2:
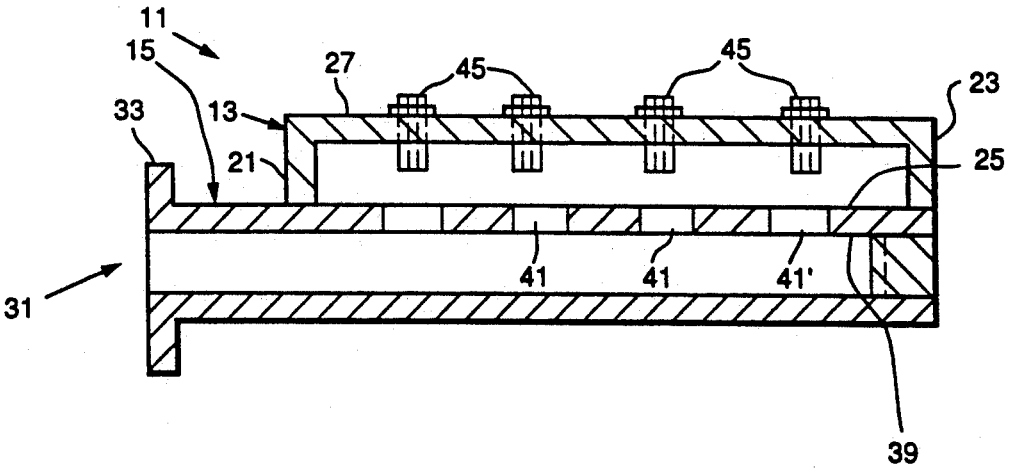
FIG. 2 is a bottom view of the flat cavity RF power divider shown in FIG. 1.

Referring now to the drawings, and more particularly to FIGS. 1 and 2, there is shown a flat cavity RF power divider 11 having a flat cavity structure 13 and an input waveguide structure 15. The flat cavity structure 13 includes a narrow upper longitudinal end wall 17, a parallel narrow lower longitudinal end wall 19, a narrow left end wall 21, and a narrow right end wall 23. Also, this structure has an inner broadwall 25 (FIG. 2), and an outer broadwall 27.

The input waveguide structure 15 is a WR-62 configuration and has an input port 31 at an outer end of the structure 15 and is fitted with a conventional waveguide flange 33. The waveguide further includes a waveguide centerline 35 (FIG. 1) and an inner waveguide wall which is shared in common with the inner broadwall 25 and is herein identified as common wall 39. As can be seen best in FIG. 1, the waveguide centerline 35 is generally centrally disposed between and parallel to the upper and lower longitudinal end walls (17 and 19) of the flat cavity structure 13.

Four longitudinal coupling slots 41 are provided in the common wall 39 along a longitudinal slot centerline 42 (FIG. 1) which is offset from the waveguide centerline 35 by 0.089 inches at an operating frequency of about 14.35 GHz. The slots 41 are spaced at 1.5 $\lambda$ g, where $\lambda$g is the WR-62 waveguide wavelength. In this configuration, the longitudinal slots will not radiate if the longitudinal slot centerline 42, along which the slots are disposed, coincides with the waveguide's centerline 35 because the transverse current is zero at the centerline of the waveguide's inner broadwall. The 0.089 inch offset location is optimized by empirical testing for this particular configuration.

A conventional curved waveguide short circuit structure 43, which is broader in bandwidth than a regular straight edge short, is disposed at $\lambda g/4$ beyond the last slot 41' from the input port 31 to create a high standing-wave along the WR-62 waveguide 15. Since the four slots 41 are spaced at multiples of quarter wavelengths, a maximum E-field will occur to excite each slot. The excited slot, in turn, excites its transverse axis column of the flat cavity depth dimension, which in this case is 0.33 inches. A dominant $TE_{4,0}$ mode is thus excited in the flat cavity structure 13.

A virtual wall (E-field at zero, not shown) exists between each excited slot column in the cavity 13. The virtual walls keep the RF propagation up or down within the flat cavity very similar to a section of waveguide. However, a virtual wall is not perfect like a real solid conductive wall and, therefore, higher ordered modes do exist.

A technique to suppress these undesirable mode conditions is to place a thin strip of conventional RF absorbing material 44 (FIG. 1) along the two longitudinal walls of the flat cavity, namely, the upper longitudinal wall 17 and the lower longitudinal wall 19. This technique increases the total insertion loss of the power divider to −3dB, but is not significant because there are conventional simple RF amplifiers (not shown) that may be used to boost the gain of each radiating element. These amplifiers incorporate conventional automatic gain control (AGC) circuitry to overcome any uneven power levels vs. frequency characteristics and output amplitude fluctuations between the output ports, as will hereinafter be described.

In this embodiment (FIGS. 1 and 2) sixteen output ports 45 are symmetrically distributed across the outer broadwall 27 of the flat cavity structure 13. The output ports 45 each include conventional SMA probes with $\lambda_0/4$ probe length penetrating into the flat cavity to couple RF energy out where $\lambda_0$ is the free-space wavelength. Thus, $\lambda_0$ is the wavelength an electromagnetic wave having the same frequency as an electromagnetic wave in the waveguide would have in free space. These ports are spaced 1.5 $\lambda$g apart on the X,Y axes.

The charts shown in FIGS. 3 and 4 provide data showing the relative phase distribution of the cavity power divider constructed as shown in FIGS. 1 and 2, from top to bottom and from left to right, respectively. FIG. 5, on the other hand shows the absolute amplitude distribution of the output array (the 16 SMA probes) of the cavity power divider of FIGS. 1 and 2, at center frequency, in this case 14.35 GHz.

For example, FIG. 3 shows the measured phase angle of each of the sixteen output ports from top to bottom for the embodiment of FIG. 1. The design phase angle for the top four ports is 0°. The phase angle of each of the top four ports is taken to be 0°. The design phase angle for the next tier of ports is −540°. The relative phase angle of each of these ports measured with respect to the first tier ports is −665°, −678°, −673° and −676°. The measured results is also shown for the two lower tiers of ports. FIG. 4 is similar to FIG. 3 except that the first column of ports provides the reference phase and the phase of the three columns to the right thereof are measured with respect to the ports in the first column. FIG. 5 shows the measured amplitude of the RF signal at each port expressed in dB which is, of course, a ratio. The theoretical distribution of RF input power to the input waveguide among sixteen output ports would provide −12 dB at each output port. There are, however, losses experienced in an actual coupler, which results in −12 dB at each output port and some variation from port to port. The actual measured values are shown in FIG. 5.

Figure 6:
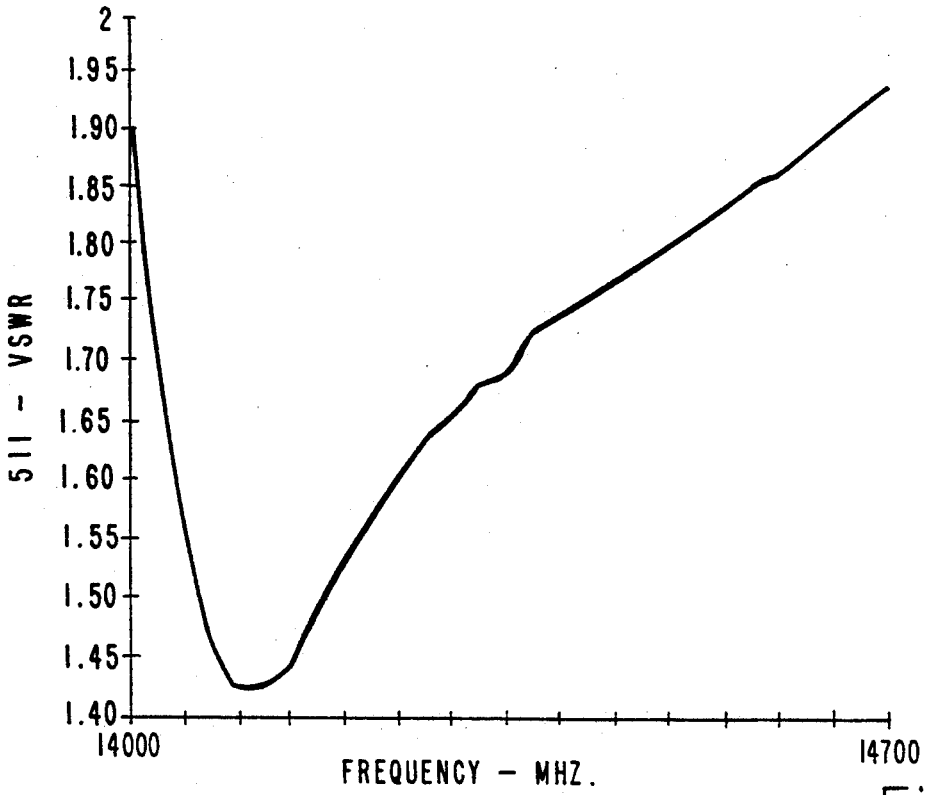
FIG. 6 is a graph of the input VSWR which is present in the flat cavity power divider of FIG. 1.

Referring now to the graph of FIG. 6, there is shown the input VSWR of the above described embodiment of the present invention. FIGS. 6–9 illustrate various performance parameters of the RF power divider of the present invention that are not necessary to an understanding of the invention or to enable one skilled in the art to practice the claimed invention. Here it can be seen that the flat cavity RF power divider shown in FIGS. 1 and 2 exhibits a VSWR that is less than 2:1 across the 5% design band (approximately 14.0 GHz to 14.7 GHz.).

Figure 7:
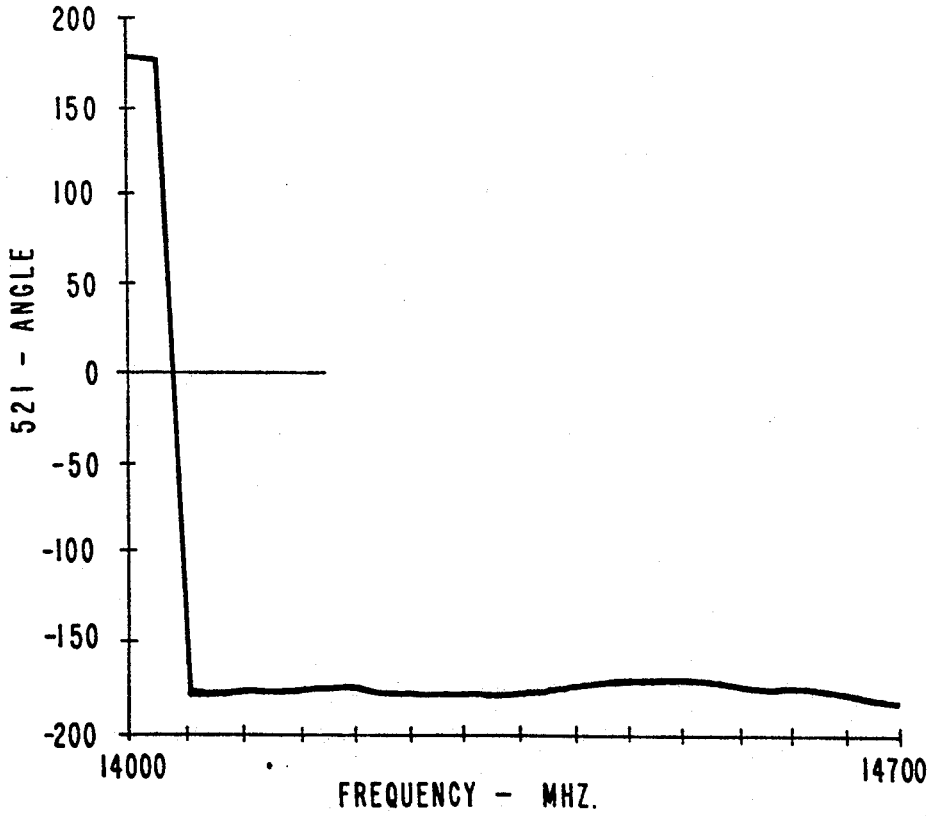
FIG. 7 is a graph of the phase output from an output port closest to a waveguide short in the cavity power divider of FIG. 1.
Figure 8:
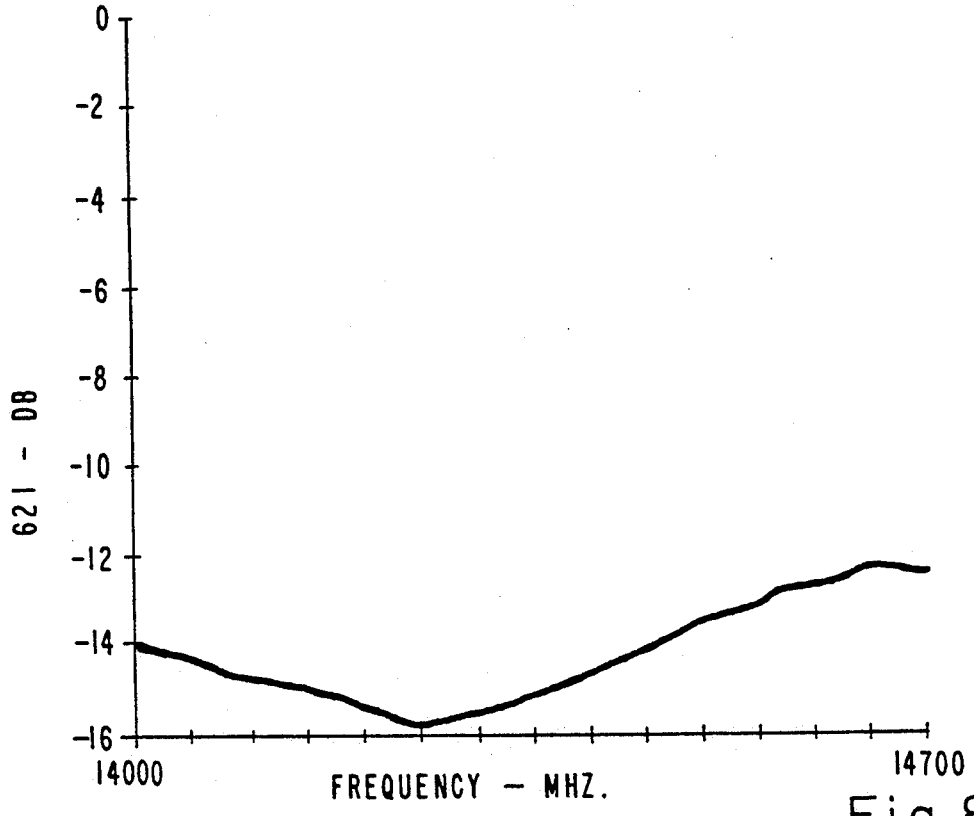
FIG. 8 is a graph of the amplitude output from the output port referenced in the above description with respect to FIG. 6.

FIG. 7 graphically illustrates the essentially constant output phase at the last output port 41', and FIG. 8 shows the output amplitude at this port. It can be seen that the phase dispersion is ±4°, and the amplitude variation is ±1.8 dB for this port.

Figure 9:
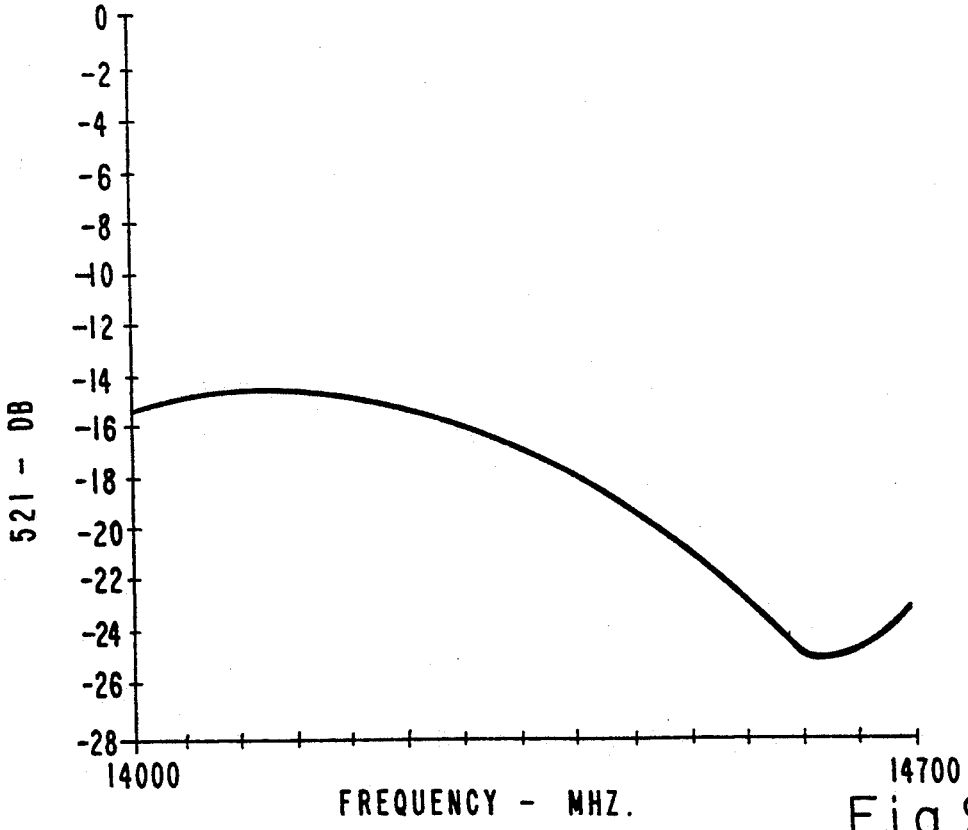
FIG. 9 is a graph exhibiting the output power present at the output port closest to the input of the flat cavity power divider of FIG. 1.

As seen in FIG. 9, the amplitude variation of the first port 41 (nearest the input port of the input waveguide 15) is ±5 dB, and while not shown, the phase dispersion has been found to be ±25° across the design frequency band. It should be noted that the first output port 41 has a much greater phase and amplitude variation than the last output port 41'. The reason for this is that the first port is located on the first column with respect to the input port 31, which is farthest from the curved waveguide short 43. Thus, output ports at column 1 result in greater phase dispersion from the waveguide short 43 than column 4, which is closest to the waveguide short. That is, phase dispersion is directly proportional to the distance between the last output slot 41' and the waveguide short 43.

Figure 10:
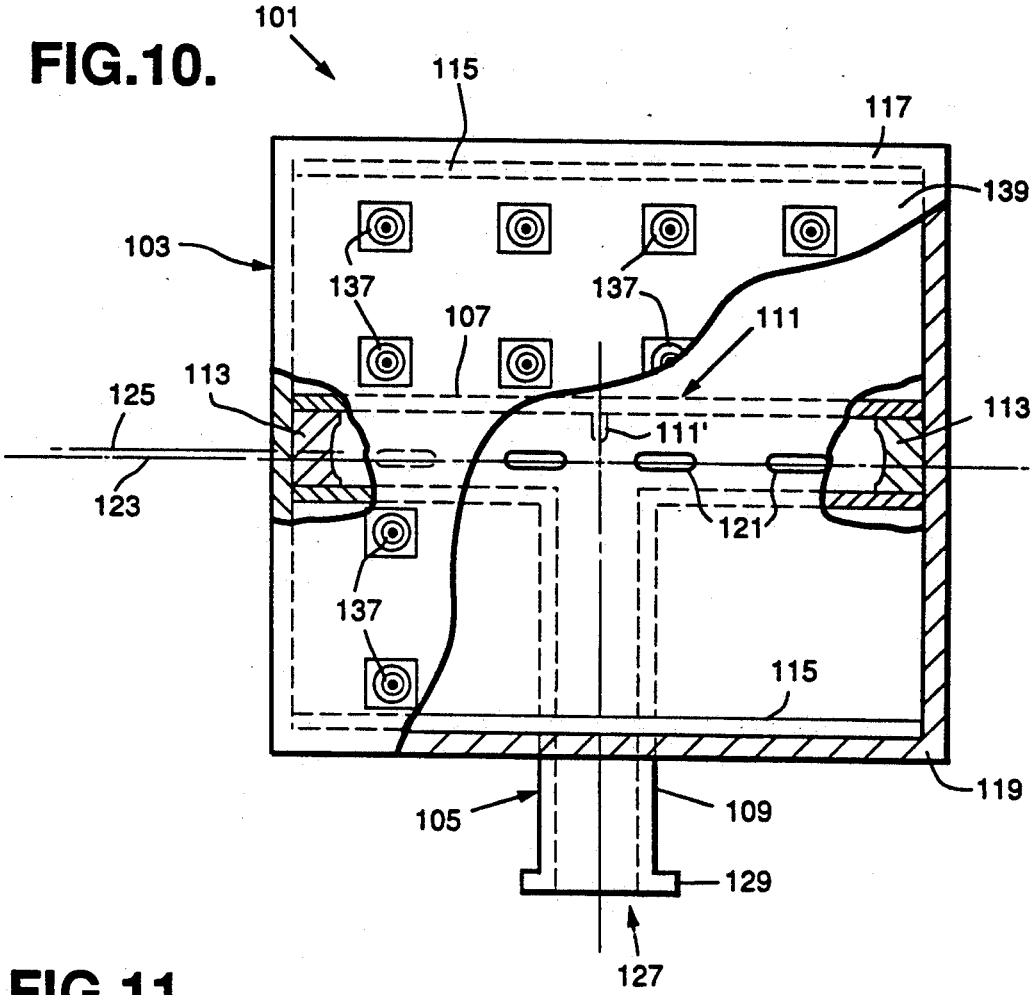
FIG. 10 is a side elevational view of a flat cavity RF power divider according to another embodiment of the present invention.
Figure 11:
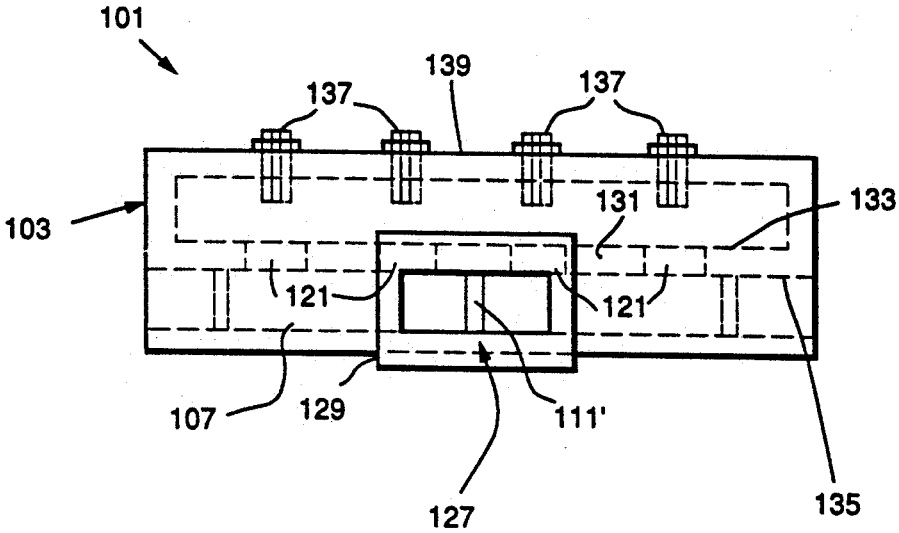
FIG. 11 is a bottom view of the flat cavity RF power divider shown in FIG. 10.

In accordance with a second embodiment of the present invention, as shown in FIGS. 10 and 11, the symmetry feeding aspects of the invention have been improved. Here, a flat cavity RF power divider 101 comprises a flat cavity structure 103 and an input waveguide structure 105. As best seen in FIG. 10, the input waveguide 105 includes two major sections, a horizontal section 107, and an orthogonally oriented input section 109. These two waveguide sections join at a waveguide junction 111, having a conventional septum 111', centrally disposed along the length of the horizontal section 107.

As best seen in FIG. 10, curved waveguide short structures 113 (similar to structures 43) are disposed at each end of the horizontal section 107. RF absorbing material 115 (FIG. 10), similar to such material 45 in the first described embodiment, is disposed along an upper longitudinal wall 117 and a lower longitudinal wall 119. As in the first described embodiment of the invention, the second embodiment shown in FIGS. 10 and 11 has four longitudinal slots 121 that lie along a waveguide centerline 123 which is offset by 0.089 inches from a waveguide section centerline 125 for the same reason as previously noted.

As shown in FIG. 10, input energy coupled to an input port 127 through input waveguide flange 129 propagates inwardly along the input waveguide section 109 and is split equally by the conventional tee junction 111, which energy is then reflected back by each short 113 to excite their corresponding two longitudinal slots 121 disposed in a common wall 131 between an inner broadwall 133 (FIG. 11) of the flat cavity 103 and an inner broadwall 135 (FIG. 11) of the horizontal section 107 of the input waveguide structure 105.

This design provides constant phase and amplitude distributions and increased frequency bandwidth at the conventional SMA probes 137 provided in an outer broadwall 139 (FIG. 11) of the flat cavity structure 103. Again, the probes are spaced as previously noted, penetrating the flat cavity about $\lambda_0/4$, and the slot dimensions are about 0.175 inches by 0.395 inches. At an operating frequency of 14.35 GHz, the internal flat cavity dimensions are 5.995 λg by 5.805 λg, with a width of 0.33 inches, and the inner width of the waveguides is 0.311 inches, while the waveguide input port openings have a dimension of 0.311 by 0.622 inches. Further, an optimum thickness for the RF absorbing material 44 and 115 has been found to be about 0.080 inches.

From the foregoing it should be understood that there has been described a new and improved flat cavity RF power divider and particularly a 1 to 16 flat cavity RF power divider that is very compact, light weight, efficient, and that accommodates forced air cooling within the power divider. It is to be understood that the above-described embodiment is merely illustrative of some of the many specific embodiments which represent applications of the principles of the present invention. Clearly, numerous and other arrangements can be readily devised by those skilled in the art without departing from the scope of the invention.

What is claimed is:

1. A flat cavity RF power divider for coupling RF energy applied thereto, said power divider comprising:

a flat cavity structure having first and second spaced apart parallel cavity broadwalls, and upper, lower, left and right narrow end walls joining said cavity broadwalls at edges thereof to enclose a flat cavity;

an input rectangular waveguide structure having first and second spaced apart waveguide broadwalls and sidewalls joined at edges thereof, an input port disposed at one end of said waveguide structure, said waveguide structure having a longitudinal centerline, a portion of one of said waveguide broadwalls being shared with a portion of one of said cavity broadwalls to constitute a common broadwall portion, and said longitudinal centerline of said waveguide structure being generally parallel to and centrally aligned between said upper and lower end walls of said flat cavity structure;

a plurality of longitudinal shunt slots disposed through said common broadwall portion for coupling the applied RF energy between said waveguide structure and said cavity structure, said longitudinal shunt slots being disposed along a longitudinal slot centerline parallel to and offset from said waveguide structure longitudinal centerline;

curved waveguide short circuit means disposed in said waveguide structure for creating a relatively high standing-wave in response to the RF energy applied thereto along said waveguide structure and for providing a maximum E-field to excite each of said slots thereby exciting an transverse axis column of said flat cavity structure;

a plurality of output ports disposed in the other broadwall of said cavity structure, each of said output ports having a respective probe penetrating into the flat cavity structure to couple out the RF energy; and whereby the RF energy applied to said waveguide structure is coupled through said slots and probes and divided among said output ports.

2. The flat cavity RF power divider according to claim 1 further comprising RF absorbing material disposed in said flat cavity structure along said upper and lower walls thereof to surpress undesired modes and to provide for improved frequency response of said power divider.

3. The flat cavity RF power divider according to claim 2 wherein said input waveguide structure is a WR-62 waveguide.

4. The flat cavity RF power divider according to claim 3 wherein said plurality of output ports comprises 16 output ports having corresponding SMA output coupling probes extending into said flat cavity structure and said coupling probes are spaced about 1.5 λg apart, where λg is the input waveguide wavelength of the applied RF energy.

5. The flat cavity RF power divider according to claim 3 wherein said curved waveguide short circuit means is spaced from a slot closest thereto by a distance of λg/4 where λg is the input waveguide wavelength of the applied RF energy.

6. The flat cavity RF power divider according to claim 3 wherein said plurality of longitudinal shunt slots comprises four slots spaced at multiples one quarter of the input waveguide wavelength of the applied RF energy.

7. The flat cavity RF power divider according to claim 6 wherein said output coupling probes extend into said flat cavity a length of $\lambda_0/4$, where $\lambda_0$ is the free-space wavelength of the applied RF energy.

8. The flat cavity RF power divider according to claim 1 wherein said input waveguide structure comprises an elongated feed section orthongonally joining an elongated horizontal feed section at a waveguide tee junction disposed at a central portion of said elongated horizontal feed section to provide symmetrical excitation of the slots, said input port being disposed at an outer end of said elongated horizontal feed section.

9. The flat cavity RF power divider according to claim 8 wherein said plurality output comprises 16 output ports having corresponding SMA output coupling probes extending into said flat cavity structure and said coupling probes are spaced about 1.5 $\lambda g$ apart, where $\lambda g$ is the input waveguide wavelength of the applied RF energy.

10. The flat cavity RF power divider according to claim 9 wherein said output coupling probes extend into said flat cavity a depth of $\lambda_0/4$, where $\lambda_0$ is the free space wavelength of the applied RF energy.

11. The flat cavity RF power divider according to claim 8 wherein said elongated horizontal feed section comprises two halves and opposite ends, and wherein said plurality of longitudinal shunt slots comprises four slots, two of which are disposed in each half of said elongated horizontal feed section.

12. The flat cavity RF power divider according to claim 11 wherein said curved waveguide short circuit means includes curved waveguide short circuit element means disposed at said opposite ends of said elongated horizontal feed section for reflecting energy incident thereon back to excite corresponding two of said longitudinal shunt slots.

* * * * *